US007432464B2

(12) United States Patent
Chiu et al.

(10) Patent No.: US 7,432,464 B2
(45) Date of Patent: Oct. 7, 2008

(54) LIGHT GUIDE FOR ILLUMINATING KEYPADS

(75) Inventors: Chien-An Chiu, Shenzhen (CN); Kuo-Chu Chang, Shenzhen (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/309,483

(22) Filed: Aug. 11, 2006

(65) Prior Publication Data

US 2007/0209918 A1 Sep. 13, 2007

(30) Foreign Application Priority Data

Mar. 8, 2006 (CN) ..... 2006 2 0056088

(51) Int. Cl.
*H01H 9/00* (2006.01)

(52) U.S. Cl. ..... 200/310; 200/341

(58) Field of Classification Search ..... 200/5 A, 200/5 R, 310–317, 341–345, 510–520; 362/601, 362/612, 615, 623
See application file for complete search history.

(56) References Cited

U.S. PATENT DOCUMENTS 4,636,593 A * 1/1987 Novak et al. ..... 200/5 A
5,053,928 A * 10/1991 Pasco ..... 362/24
5,083,240 A 1/1992 Pasco
5,149,923 A * 9/1992 Demeo ..... 200/5 A
5,340,955 A * 8/1994 Calvillo et al. ..... 200/302.2
6,207,912 B1 * 3/2001 Persson ..... 200/305
6,909,063 B2 * 6/2005 Nam ..... 200/406
6,977,352 B2 * 12/2005 Oosawa ..... 200/314
7,019,242 B2 * 3/2006 Kim ..... 200/514
7,064,288 B2 * 6/2006 Nam ..... 200/406
7,113,670 B2 * 9/2006 Robinson et al. ..... 385/31
2004/0055862 A1 * 3/2004 Nam ..... 200/512
2004/0062028 A1 * 4/2004 Winston et al. ..... 362/31
2005/0128188 A1 * 6/2005 Chien et al. ..... 345/168
2005/0141244 A1 * 6/2005 Hamada et al. ..... 362/612
2005/0279617 A1 * 12/2005 Han ..... 200/310
2006/0042923 A1 * 3/2006 De Richecour et al. ..... 200/512

* cited by examiner

*Primary Examiner*—Michael A. Friedhofer
*Assistant Examiner*—Lisa Klaus
(74) *Attorney, Agent, or Firm*—Wei Te Chung

(57) ABSTRACT

A light guide (30) for illuminating a keypad (20) including a plurality of keys (22) includes a plurality of apertures (300) corresponding to the keys, and a plurality of slots (340). The slots are defined in a face of the light guide adjacent to the keypad.

16 Claims, 4 Drawing Sheets

LIGHT GUIDE FOR ILLUMINATING KEYPADS

CROSS-REFERENCE TO RELATED APPLICATION

This present application is related to two co-pending U.S. patent applications both entitled "LIGHT GUIDE FOR ILLUMINATING KEYPADS", with application Ser. Nos. 11/309,485 and 11/309,481 and both being filed on Aug. 11, 2006 and assigned to the same assignee as that of the present application.

FIELD OF THE INVENTION

The invention relates to light guides, and particularly to a light guide for illuminating a keypad or keyboard uniformly.

DESCRIPTION OF RELATED ART

It is common to illuminate a keypad or keyboard of an electronic device, such as a mobile telephone, to facilitate nighttime use. Each individual key may be illuminated by a respective light source located directly behind the key. This arrangement is, however, very expensive since a separate light source is required for each key. Furthermore, the power dissipation of the mobile telephone is increased, and the standby time of the mobile telephone is shorter.

A more economical approach utilizes fewer distributed light sources and the light is directed towards the keys with the aid of a light guide in the form of a transparent plate. Referring to FIG. 4, a plan view of a conventional light guide 50 is shown. The light guide 50 comprises a plurality of V-shaped notches 52 defined at a periphery thereof, and an array of apertures 520 arranged in four rows and three columns. The apertures 520 are rectangular with rounded corners, corresponding to keys 60 of a keypad. Four light sources, such as light-emitting diodes, are located behind the light guide 50. In a vicinity of each of the light sources, the light guide 50 comprises a respective convex lens 70 formed integrally therewith. Aligned with the lens 70, adjacent to a front face of the light guide 50, there is provided a prismatic indentation 72, which offers four reflecting surfaces each having a triangular outline. The light from the light source is collimated by the lens 70 into a beam traveling transversely into the light guide 50, then the prismatic indentation 72 serves to direct the beam into a plane of the light guide 50 by means of total internal reflection to illuminate the keys 60. However the number of the light sources is four, and the power dissipation of the mobile telephone is still too great. In addition, the illumination is not uniform as the brightness of the keys 60 adjacent to the light source is greater than that of the keys 60 away from the light source, and the cost of manufacturing the light guide 50 is greater because the lens 70 is formed integrally with the light guide 50.

Therefore, a heretofore unaddressed need exists in the industry to overcome the aforementioned deficiencies and inadequacies.

SUMMARY OF THE INVENTION

An aspect of the invention provides a light guide for illuminating a keypad including a plurality of keys. The light guide includes a plurality of apertures corresponding to the keys, and a plurality of slots. The slots are defined in a face of the light guide adjacent to the keypad.

Another aspect of the invention provides an electronic device. The electronic device includes a keypad, a light guide disposed under the keypad, and at least one light source. The keypad includes a plurality of keys. The light guide includes a plurality of apertures corresponding to the keys, at least one receiving hole, and a plurality of slots defined in a face thereof adjacent to the keypad. The at least one light source is received in the at least one receiving hole of the light guide.

Other advantages and novel features will become more apparent from the following detailed description of preferred embodiments when taken in conjunction with the accompanying drawings, in which:

DETAILED DESCRIPTION OF THE INVENTION

Figure 1:
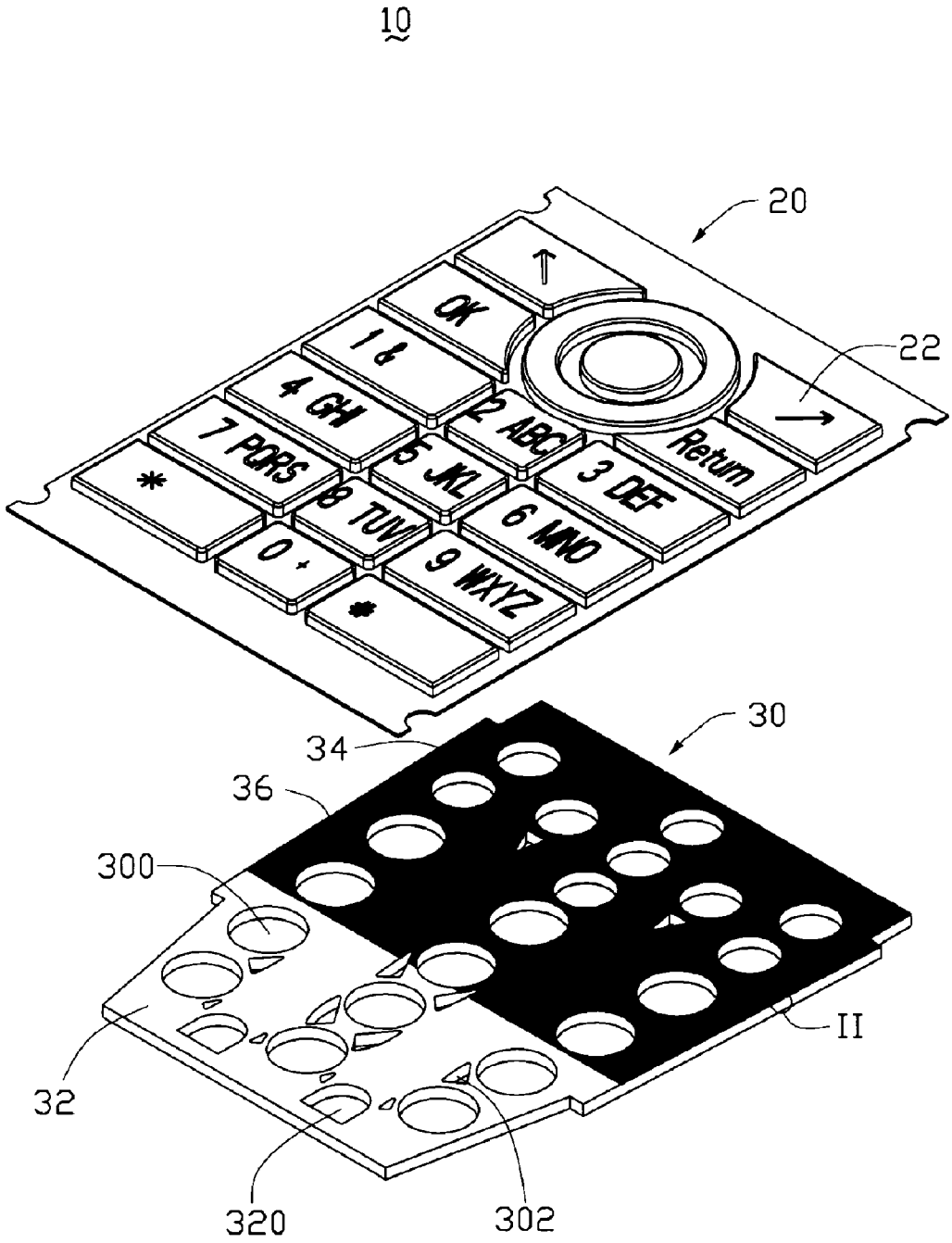
FIG. 1 is an exploded, isometric view of an electronic device of an exemplary embodiment of the present invention, the electronic device comprising a keypad and a light guide.

Referring to FIG. 1, an electronic device 10 of an exemplary embodiment of the present invention is shown. The electronic device 10 comprises a keypad 20 and a light guide 30.

The keypad 20 has a generally rectangular profile. The keypad 20 comprises a plurality of keys 22. Each of the keys 22 comprises a key column (not shown).

Figure 2:
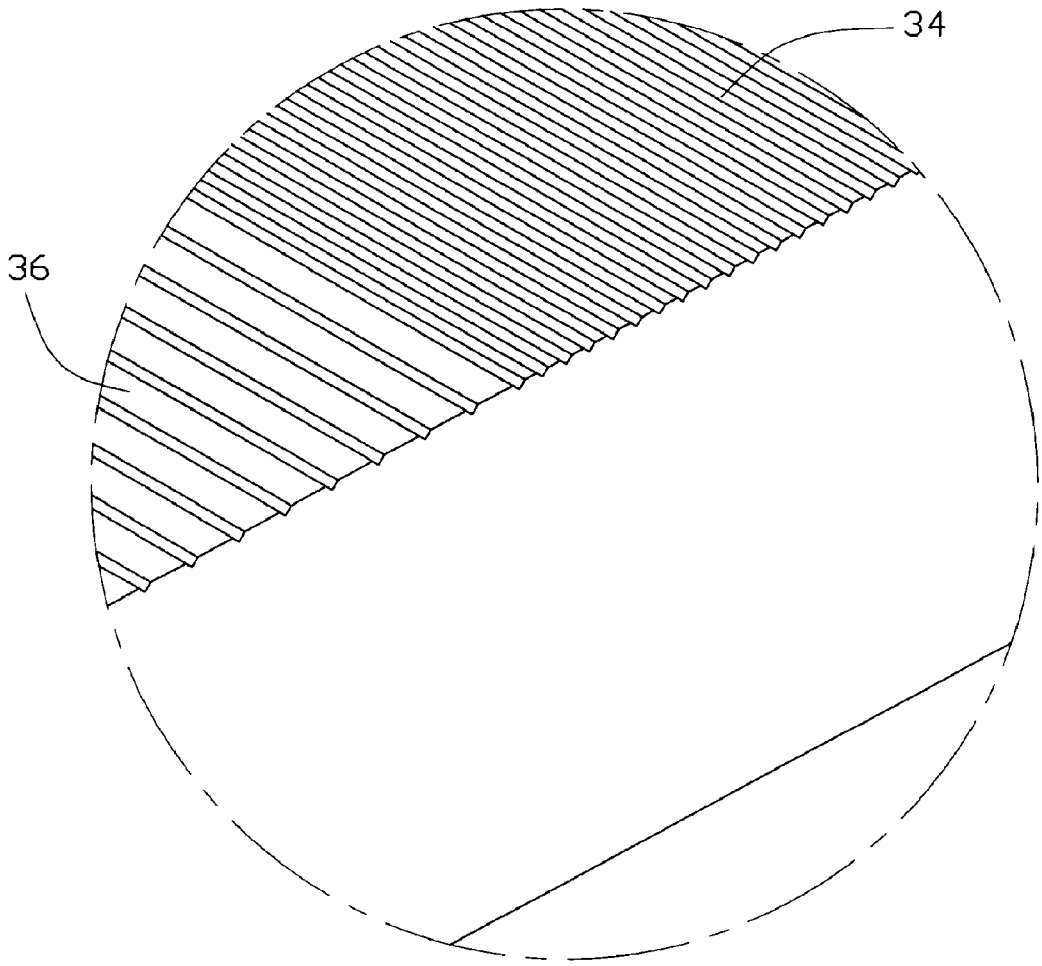
FIG. 2 is an enlarged view of a circled portion 11 of FIG. 1.
Figure 3:
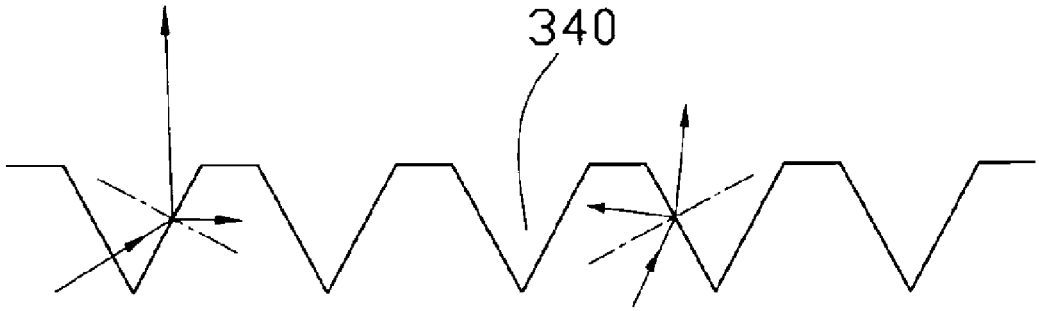
FIG. 3 is a schematic diagram of light reflecting in the light guide of FIG. 1.
Figure 4:
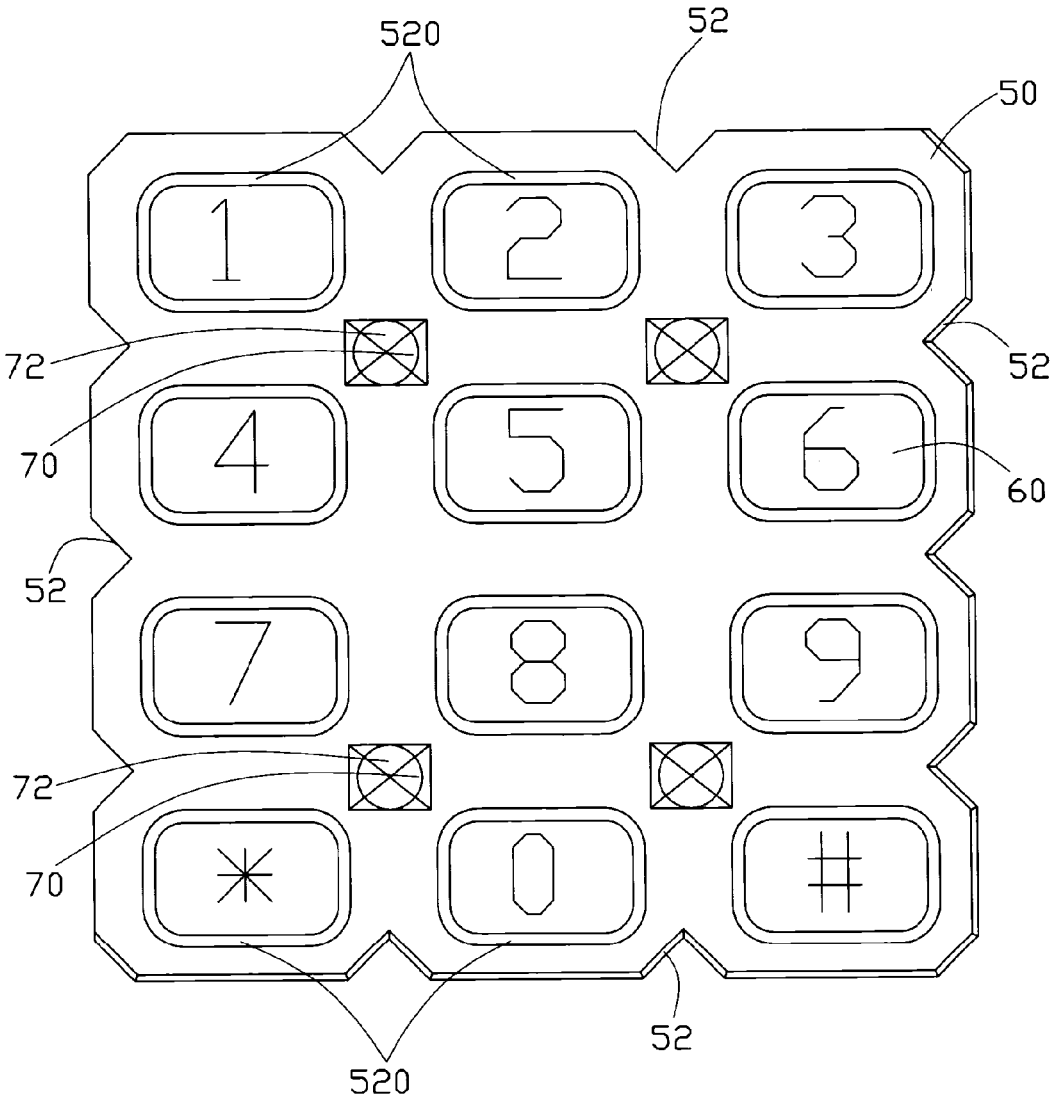
FIG. 4 (RELATED ART)
FIG. 4 is a plan view of a conventional light guide.

Referring also to FIGS. 2 and 3, the light guide 30 can be mounted on a circuit board comprising a pair of light sources, for example, two light-emitting diodes (not shown). The light guide 30 is a transparent plate. The light guide 30 comprises a first end portion 32, a second end portion 34, and a middle portion 36 connecting the first end portion 32 with the second end portion 34. A pair of spaced receiving holes 320 is defined in an end of the first end portion 32 away from the middle portion 36. The receiving holes 320 are for receiving the light sources, and define surfaces therein to receive light from the light sources. A plurality of parallel V-shaped slots 340 is defined transversely in the second end portion 34 and the middle portion 36 on a surface of the light guide 30 adjacent to the keypad 20. A distance between each two adjacent slots 340 of the second end portion 34 is less than that between each two adjacent slots 340 of the middle portion 36.

The light guide 30 comprises a plurality of apertures 300 corresponding to the keys 22 of the keypad 20. The apertures 300 are generally positioned in three columns. One of the columns of the apertures 300 is positioned in a lengthwise central line of the light guide 30. The receiving holes 320 are symmetrically positioned to either side of an end of the central column of the apertures 300 in the first end portion 32. The light guide 30 further comprises two apertures 300 defined in the second end portion 34 and respectively positioned axes of the receiving holes 320. In the exemplary embodiment, the light sources are light-emitting diodes. A preferred illumination range within which power of illumination from the LEDs is greatest is 120° centered about the axis of each receiving hole 320. Thus, at least a portion of each key 22 of the keypad 20 is positioned in the illumination range of 120° corresponding to that of the light sources.

The light guide 30 also comprises a plurality of holes 302. Each hole 302 is triangular shaped. Some of the holes 302 are disposed near the apertures 300 adjacent to the receiving holes 320, and two of the holes 302 are respectively positioned in the axes of the receiving holes 320. That is, the holes 302 are disposed near the keys 22 where illumination is greatest. Thereby, the light from the light sources can be easily introduced into the keypad 20, and illuminate the keypad 20 uniformly.

In assembly, the key columns of the keys 22 of the keypad 20 are received in the apertures 300 of the light guide 30, respectively, thereby the keypad 20 and the light guide 30 are mounted together.

In use, the light from the light sources in the receiving holes 320 is introduced into the light guide 30, and reflects within the light guide 30. Because the slots 340 are defined in the second end portion 34 and the middle portion 36, and the light sources are in the receiving holes 320 of the first end portion 32 having no slots 340, the number of times that the light reflects within the first end portion 32 is less than that of the second end portion 34 and the middle portion 36. Further, because the distance between each two adjacent slots 340 of the second end portion 34 is less than that between each two adjacent slots 340 of the middle portion 36, the number of times that the light reflects within the middle portion 36 is less than that of the second end portion 34. In this way, the loss of illuminating power as the light travels through the light guide 30 is compensated for by the increase in density of the number of reflections over distance. Thus, a brightness of the portion of the light guide 30 away from the light sources is comparable to a brightness of the portion of the light guide 30 near the light sources, so that a uniform brightness is obtained. Furthermore, the number of light sources used in the electronic device 10 is reduced, and the standby time of the electronic device 10 is prolonged.

In an alternative embodiment, the slots 340 may be defined in the first end portion 32, the middle portion 36, and the second end portion 34. A width of each of the slots 340 reduces gradually from the first end portion 32 to the second end portion 34. Alternatively, a width of each slot 340 defined in the middle portion 36 is slightly greater than that of each slot 340 defined in the first end portion 32, but less than that of each slot 340 defined in the second end portion 34.

While exemplary embodiments have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A transparent light guide for illuminating a keypad, wherein the keypad includes a plurality of keys, the light guide comprising:

a plurality of apertures, corresponding to the keys;

at least one receiving hole defined in an end thereof, for receiving at least one light source; and a plurality of slots defined in a face thereof adjacent to the keypad, wherein widths of the slots reduce along a direction away from the at least one receiving hole.

2. The light guide as claimed in claim 1, wherein each of the slots is V-shaped.

3. The light guide as claimed in claim 2, wherein the slots are defined parallelly and transversely in the light guide.

4. The light guide as claimed in claim 3, further comprising a first end portion, a second end portion, and a middle portion connecting the first end portion and the second end portion.

5. The light guide as claimed in claim 4, wherein the slots are defined in the second end portion and the middle portion.

6. The light guide as claimed in claim 5, wherein a distance between each two adjacent slots defined in the middle portion is greater than that between each two adjacent slots defined in the second end portion.

7. An electronic device, comprising:

a keypad comprising a plurality of keys;

a transparent light guide disposed under the keypad, the light guide comprising a plurality of apertures corresponding to the keys, at least one receiving hole, and a plurality of slots defined in a face thereof adjacent to the keypad, wherein widths of the slots reduce along a direction away from the at least one receiving hole; and at least one light source received in the at least one receiving hole of the light guide.

8. The electronic device as claimed in claim 7, further comprising a plurality of holes disposed near at least one of the apertures, respectively.

9. The electronic device as claimed in claim 8, wherein each of the holes is triangular shaped.

10. The electronic device as claimed in claim 7, wherein each of the slots is V-shaped.

11. The electronic device as claimed in claim 7, wherein the slots are defined parallelly and transversely in the light guide.

12. The electronic device as claimed in claim 7, wherein the light guide further comprises a first end portion, a second end portion, and a middle portion connecting the first end portion and the second end portion.

13. The electronic device as claimed in claim 12, wherein the slots are defined in the second end portion and the middle portion.

14. The electronic device as claimed in claim 13, wherein a distance between each two adjacent slots defined in the middle portion is greater than that between each two adjacent slots defined in the second end portion.

15. An electronic device comprising:

a keypad comprising a plurality of keys installable and extending along a user-accessible side of said electronic device;

a light source installable in said electronic device for illuminating said plurality of keys of said keypad; and a transparent light guide installable in said electronic device beside said light source and said keypad, respectively, to transmit light from said light source toward said keypad through said light guide, said light guide comprising a first surface facing said light source to receive said light from said light source into said light guide and a second surface facing said keypad to transmit said light out of said light guide toward said keypad, a plurality of parallel slots formed at said second surface facing said keypad so as to enhance uniformity of transmission of said light out of said second surface of said light guide;

wherein a distance between each two adjacent slots out of said plurality of slots decreases when said each two adjacent slots are located at said second surface farther away from said light source.

16. The electronic device as claimed in claim 15, wherein said second surface defines a first end portion close to said first surface, a second end portion far away from said first surface and a middle portion connectively extending between said first and second end portions, and said plurality of parallel slots are exclusively formed at said second end portion and said middle portion.

* * * * *